US005378051A

United States Patent [19]

Kirkkala et al.

[11] Patent Number: 5,378,051

[45] Date of Patent: Jan. 3, 1995

[54] METHOD OF MAKING A BRUSH ELEMENT FOR A BRUSH ROLLER

[75] Inventors: Mauno Kirkkala, Lankipohja; Reijo Kuivikko, Tampere, both of Finland

[73] Assignee: Oy C.E. Lindren Ab, Porvoo, Finland

[21] Appl. No.: 159,772

[22] Filed: Nov. 30, 1993

Related U.S. Application Data

[60] Division of Ser. No. 933,112, Aug. 21, 1992, abandoned, which is a continuation-in-part of Ser. No. 583,797, Sep. 17, 1990, Pat. No. 5,155,875.

[30] Foreign Application Priority Data

Sep. 18, 1989 [FI] Finland ..... 894378
Mar. 16, 1990 [FI] Finland ..... 901314

[51] Int. Cl.[6] ..... A46B 3/02; A46B 3/16; A46D 3/00

[52] U.S. Cl. ..... 300/21; 15/183; 15/193; 15/195; 15/199

[58] Field of Search ..... 15/23, 54, 55, 71–73, 15/159.1, 176.5, 179–183, 186, 190–193, 195, 198, 199, 200, 207.1, 191.1; 300/21; 29/110, 120, 121.1–121.3, 121.5, 125; 264/243

[56] References Cited

U.S. PATENT DOCUMENTS

| | | | |
|---|---|---|---|
| 390,715 | 10/1888 | Strickel | 15/199 |
| 951,432 | 3/1910 | Bowditch | 15/192 |
| 1,398,035 | 11/1921 | Morrison | 15/193 X |
| 1,405,938 | 2/1922 | Rasmesen, Jr. | 15/197 |
| 1,942,205 | 1/1934 | Elnett | 15/114 |
| 1,949,665 | 3/1934 | Stugis | 300/21 |
| 2,241,876 | 5/1941 | Cohen | 15/160 X |
| 2,450,679 | 10/1948 | May | 15/183 X |
| 2,790,986 | 5/1957 | Schwartz et al. | 15/192 |
| 2,854,684 | 10/1958 | Hardman et al. | 300/21 X |
| 2,879,534 | 3/1959 | Swanson et al. | 15/179 |
| 2,978,726 | 4/1961 | Park | 15/183 |
| 3,120,671 | 2/1964 | Miller | 15/179 |
| 3,124,823 | 3/1964 | Charvat | 300/21 X |
| 3,139,641 | 7/1964 | Grogan et al. | 15/179 X |
| 3,142,081 | 7/1964 | Hartz et al. | 300/21 X |
| 3,200,430 | 8/1965 | Haracz | 15/183 |
| 3,225,374 | 12/1965 | Daley et al. | 15/183 |
| 3,533,125 | 10/1970 | Buechel et al. | 15/183 |
| 3,574,880 | 4/1971 | Butzen | 15/195 X |
| 3,715,773 | 2/1973 | Drumm | 15/183 |
| 4,214,346 | 7/1980 | McDonald | 15/183 X |
| 4,346,494 | 8/1982 | Peabody et al. | 15/199 X |
| 4,498,210 | 2/1985 | Drumm | 15/183 |
| 4,627,127 | 12/1986 | Dupre | 15/182 X |

FOREIGN PATENT DOCUMENTS

| | | | |
|---|---|---|---|
| 757174 | 10/1933 | France | 15/192 |
| 791045 | 12/1935 | France | 29/121.2 |
| 2419046 | 11/1979 | France | 15/195 |
| 821781 | 11/1951 | Germany | 15/190 |
| 862308 | 1/1953 | Germany . | |
| 921985 | 1/1955 | Germany . | |
| 1057565 | 5/1959 | Germany . | |
| 1956004 | 5/1971 | Germany . | |
| 2329597 | 1/1975 | Germany . | |
| 376472 | 5/1964 | Switzerland . | |
| 425514 | 5/1967 | Switzerland | 15/179 |
| 196724 | 5/1923 | United Kingdom | 15/179 |
| 286937 | 3/1928 | United Kingdom | 15/190 |

*Primary Examiner*—David A. Scherbel
*Assistant Examiner*—Charles Cooley
*Attorney, Agent, or Firm*—C. J. Fildes & Co.

[57] ABSTRACT

A method for making a brush element for a brush roller wherein bristle bunches formed by folding bristles over bent portions of U-shaped staples have their folded portions and associated staples inserted through tight fitting apertures in a base portion of a frame so that legs of the staples are bent by collision with a facing side of an attachment section of the frame. A hardenable adhesive is then poured into the frame between the base portion and the facing side around the staples and folded portions of the bristle bunches. The adhesive is hardened, bonding the staples in the adhesive and affixing the bristles to the base portion. The adhesive may be a polyurethane-base resin having viscosity allowing absorption of the adhesive between the bristles near their folded portions, the tight fit of the bristles in the apertures holding them in place during pouring and hardening of the adhesive.

4 Claims, 6 Drawing Sheets

METHOD OF MAKING A BRUSH ELEMENT FOR A BRUSH ROLLER

CROSS-REFERENCE TO RELATED APPLICATION

This is a division of application Ser. No. 07/933,112 filed Aug. 21, 1992, now abandoned, which is a continuation-in-part of application Ser. No. 07/583,797 filed Sep. 17, 1990, now U.S. Pat. No. 5,155,875.

TECHNICAL FIELD

This invention relates to rotating brushes and more particularly to a brush roller and an improved method for making its brush element used for glazing cardboard wherein the roller consists of a cylinder section having improved brush elements attached to it and in each element the brushes are attached essentially in a radial direction.

BACKGROUND ART

Modern cardboard glazing brushes are manufactured in such a way that a steel cylinder, revolving on bearings at its ends, and with a length of 1500–10,000 mm, acts as a frame section for the brush roller. This cylindrical brush roller weighs 400–4000 kg, depending on its construction. The frame section of the brush roller is covered with plates made from about 10 mm thick aluminum, the width of which is about 100 mm, and the length 1000 mm. The plates, which are bent to the form of the outer surface of the cylinder, are secured with screws in rows to the surface of the roller brush. Holes with a diameter of about 5 mm are drilled in the aluminum at about 10 mm centers, and horsehairs from a horse's mane, with a length of about 60 mm from the surface of the aluminum plate, are attached to the hole by the traditional hand-binding method. The aluminum plates made in this way are first brushed with thin glue on the underside, which partly penetrates the fibers in the drilled holes, binding the individual fibers to one another. In addition, the underside of the plates is brushed with a thick layer of polyurethane, which prevents the brush from unravelling if the binding wire breaks. This method, which is in use at present, is, however, a quite expensive and slow method of manufacture, due to the large amount of handwork. A brush roller that must be sent for re-brushing must first of all be removed from the cardboard machine and sent to a brush factory. There the aluminum plates are removed from the roller brush and the polyurethane on the underside of the aluminum plates is either dissolved or ground away, after which the remaining fibers are twisted out of the holes and the holes in the aluminum plate are individually drilled clean before re-binding. There are 40,000–120,000 holes in a single roller brush, depending on its size. After binding and re-gluing, the plates are once again attached to the surface of the roller brush and the uneven ends of the fibers remaining from hand binding are levelled to their correct length and the roller brush is balanced before being returned to the cardboard mill. Due to this time-consuming re-brushing cardboard mills have had to keep extra brush rollers, because some of the rollers must always be re-brushed. The long delivery dates have also been a great problem.

DISCLOSURE OF INVENTION

An object of this invention is to create a brush roller system, in which the brush rollers need no longer be removed from the machine, but new throw-away brush elements can be changed quickly in the cardboard machine. Extra brush rollers are then no longer required, neither are expensive return freight charges, nor the re-balancing of the roller. Cardboard mills can maintain a store of the throw-away brush elements in accordance with the invention, which take up little space, in which case problematic situations due to delays in deliveries will no longer arise.

Another object of the present invention is to provide an improved method for making a brush element wherein more bristles can be mounted per surface area than with conventional mechanical mounting techniques.

Yet another object of this invention is to provide a method for making an improved brush element wherein staples that mount bristles are bonded thereto to improve the mounting of the bristles on the brush element.

A further object of the present invention is to provide an improved brush element for a brush roller wherein the staples are less susceptible to withdrawal vis-a-vis driven in staples.

In carrying out the above objects and other objects of the invention, a method of making a brush element for a brush roller includes fabricating a frame including a base portion having outer and inner sides also an attachment section including first and second sides. The inner side of the frame is spaced from and faces the second side of the attachment section. A pair of apertures is formed in the base. A plurality of bristles is folded in half over a U-shaped staple and the staples are inserted into the formed pair of apertures in the base portion such that the folded portion of the bristles is on the inner side of the base and the free end portion extends from the outer side of the base portion. A hardenable adhesive or cast component is poured along the inner side of the base portion around the folded portion of the bristles and staples to bond the staples in the adhesive as it hardens and to affix the bristles to the base portion.

In a preferred embodiment, the legs of the U-shaped staples are bent prior to the pouring of the cast component to make it necessary to unbend the legs to remove the staples. In contrast to conventional techniques wherein U-shaped staples work as spikes penetrating into the base, the U-shaped staples herein are inserted through the apertures and are bent through contact with the inner side of the frame or through other means.

A brush roller for the glazing of cardboard includes a cylinder section having brush elements attached to it. Each element has bristles that are attached in essentially a radial direction. The cylinder of the brush roller includes longitudinal rails or guides and each element includes an indentation that secures the element to the rail. Each rail is arranged so that one or several elements can be pushed onto it in sequence.

Each brush element includes a frame section, bristles and an attachment section. Several holes are formed in the base surface of the frame section into which the bunched and bent bristles are placed to thereby extend essentially through the base section. The other side includes a hardenable adhesive or cast component which secures the ends of the tufts to the element as the hardenable adhesive or cast component cures about the tufts. A securing section includes an indentation to attach the element to the guide which runs in the direction of an axle.

Preferably, the indentation is formed in an aluminum securing section, the opposite side of which includes gripping lugs which are also bonded to the hardenable adhesive or cast component. Herein the indentation surface of the aluminum section that forms the indentation includes a Teflon surface. The edges of the brush element in the direction of the guide are parallel and angled in such a way that two elements adjacent about each other and the brush elements provide complete brush coverage about the roll.

In the preferred embodiment, the tufts of the bristles include U-shaped staples by means of which the tufts are bent and pushed through the holes formed in the base surface of the frame section when the U-shaped staples remain inside the cast component.

In an alternative embodiment of the invention, the brush element includes a frame section including a hollow on the bristle side into which pre-stress bristles are set as a unified tuft sunk into the hardenable adhesive or cast component that is set on the base.

The objects, features and advantages of the present invention are readily apparent from the following detailed description of the best mode for carrying out the invention when taken in connection with the accompanying drawings.

Figure 3:
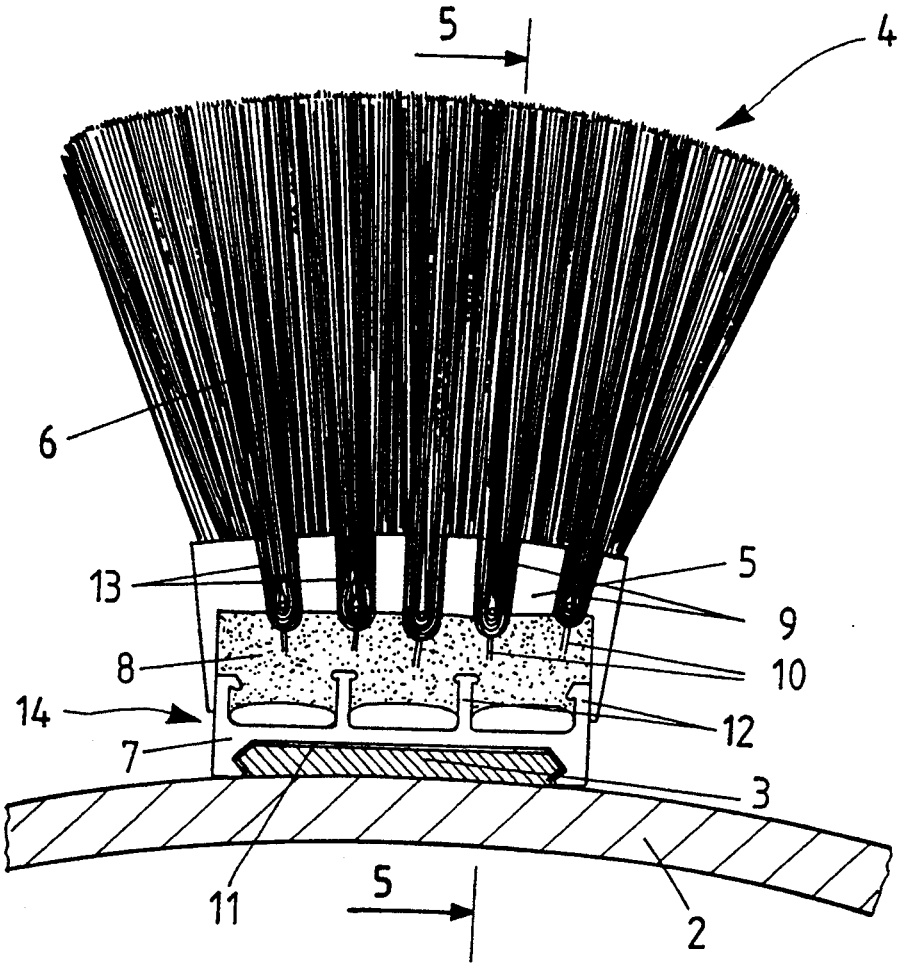
FIG. 3 illustrates an enlarged cross-sectional view of a part of the brush roller and a brush element mounted therein.
Figure 4:
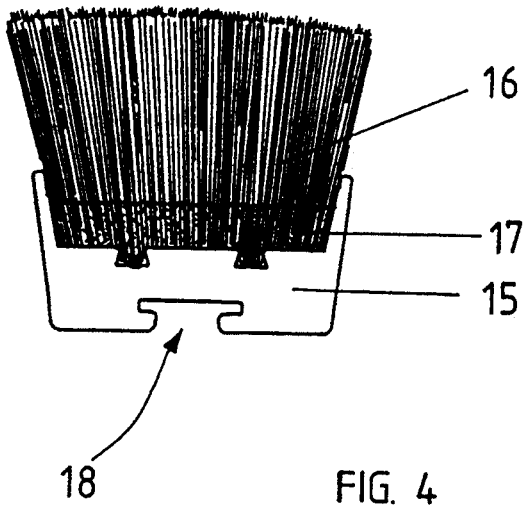
FIG. 4 illustrates an alternative embodiment of the brush element.
Figure 5:
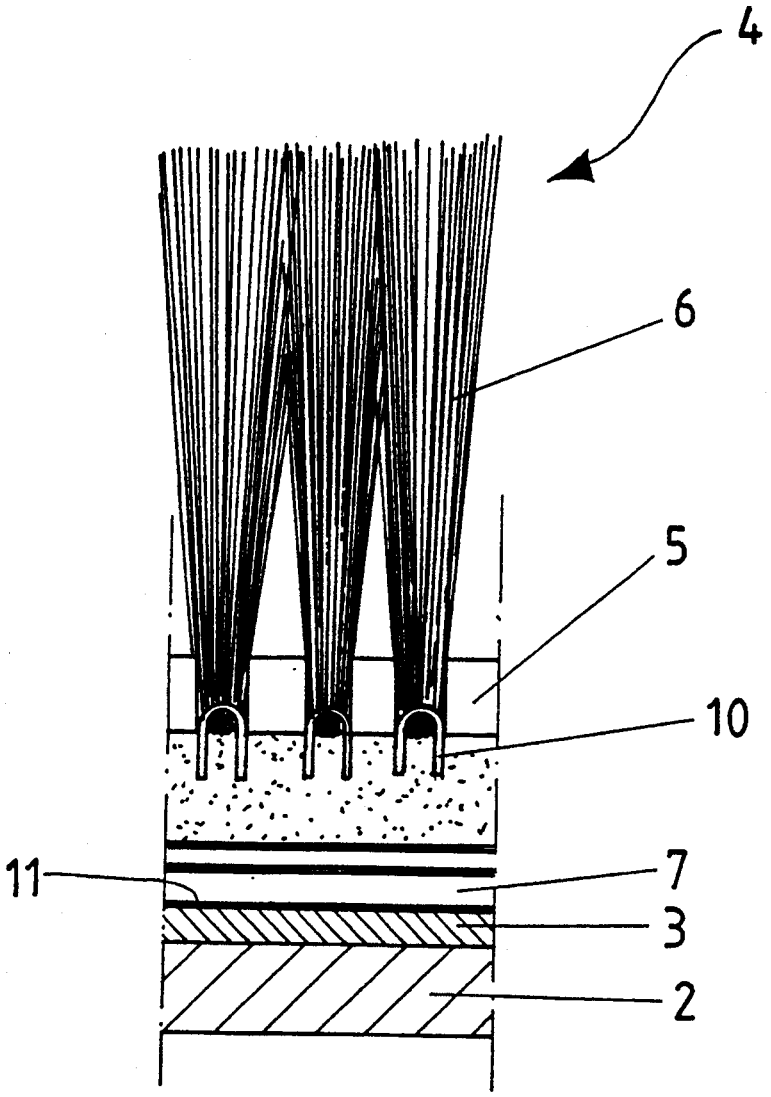
FIG. 5 is a cross-sectional view taken along line 5—5 of FIG. 3.
Figure 6A:
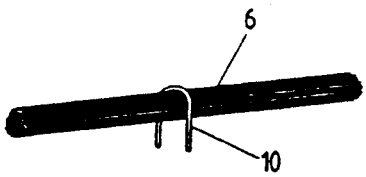
Figure 6B:
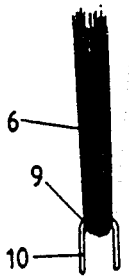
Figure 6C:
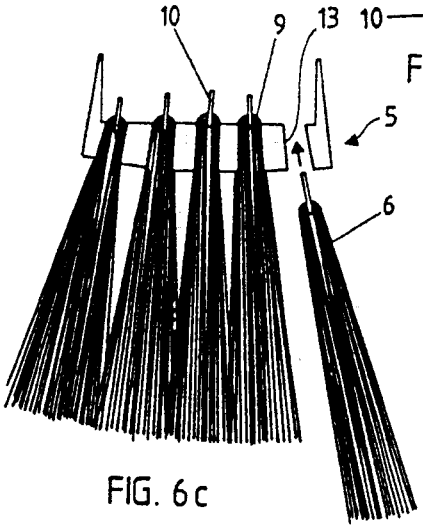
Figure 6D:
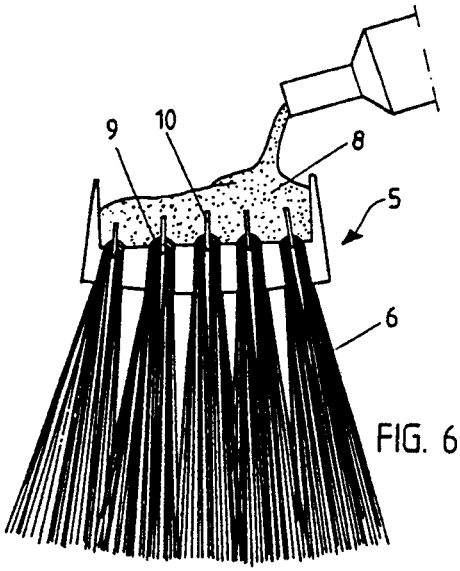
Figure 6E:
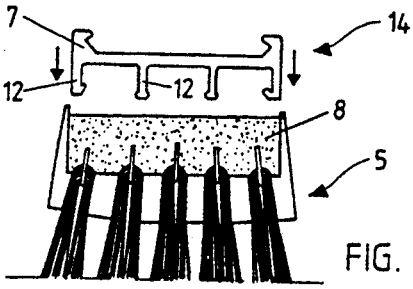
Figure 6F:
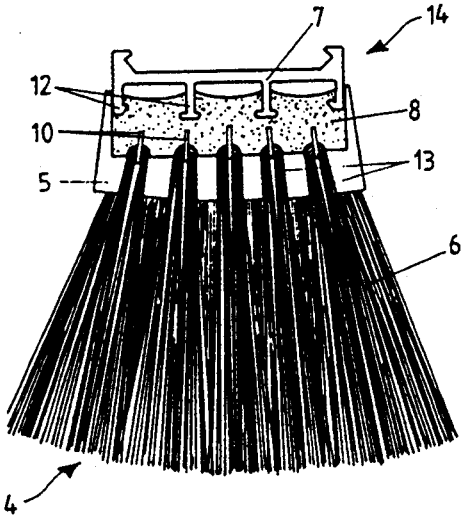
Figure 7A:
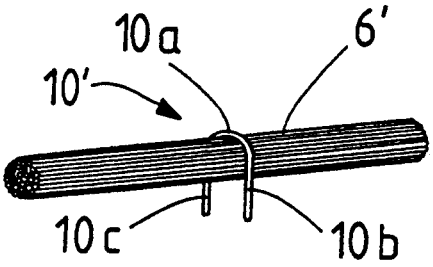
Figure 7C:
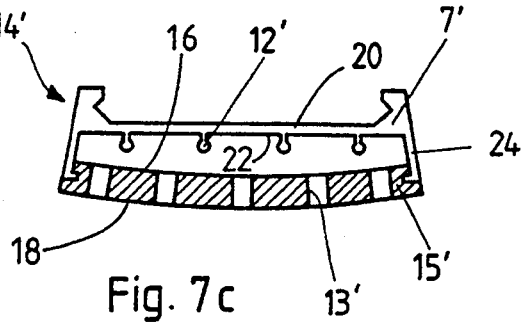
Figure 7B:
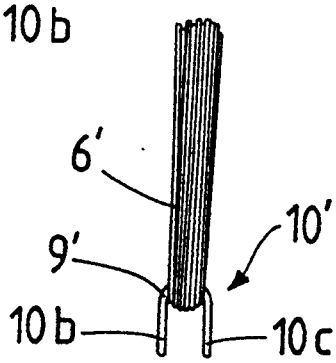
Figure 7D:
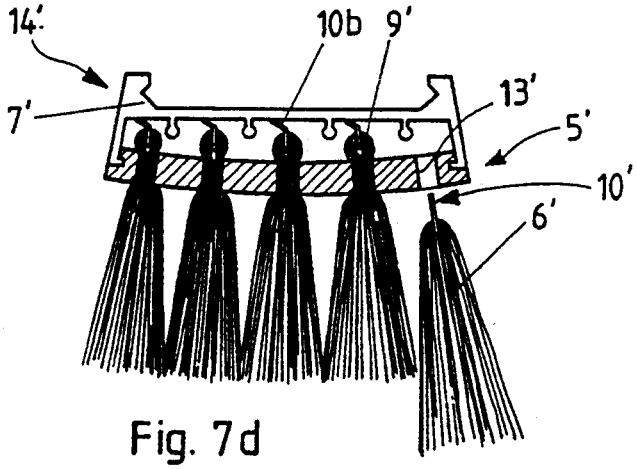
Figure 7E:
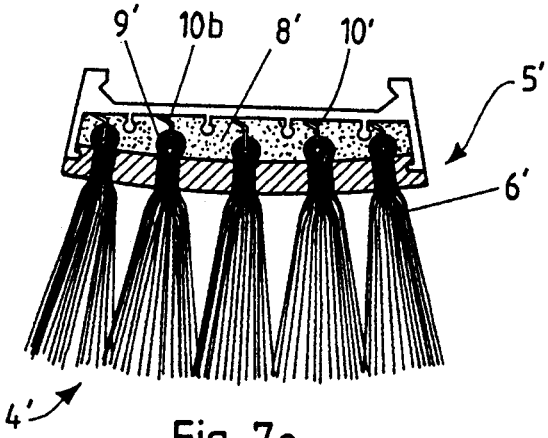
Figure 8:
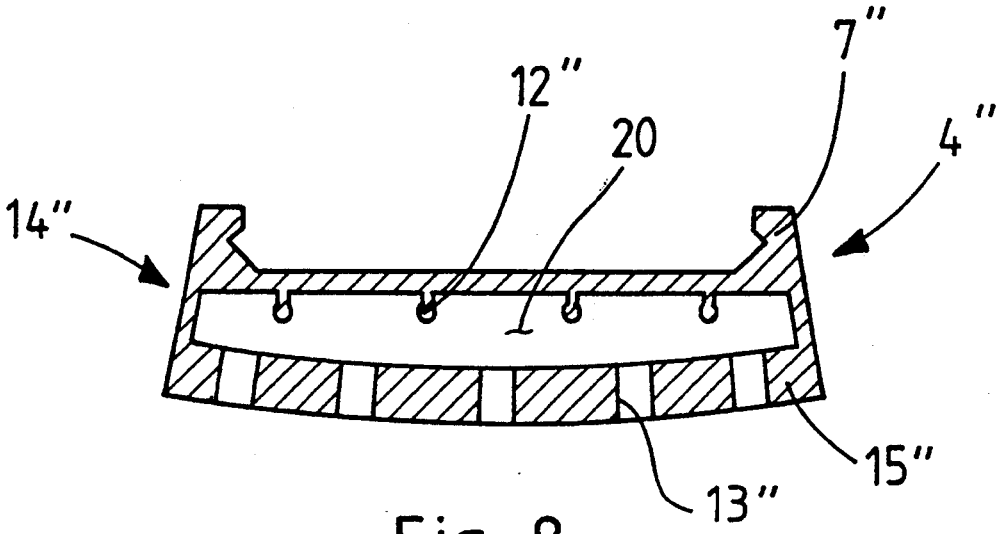

FIGS. *6a–6f* illustrate through successive illustrations the detailed construction of the brush element of FIGS. 3–5;

FIGS. *7a–7e* illustrate through successive illustrations the detailed construction of another embodiment of the brush element; and FIG. 8 illustrates a cross-sectional view of yet another embodiment of the brush element wherein a base section and attachment section are integral.

BEST MODE FOR CARRYING OUT THE INVENTION

Figure 1:
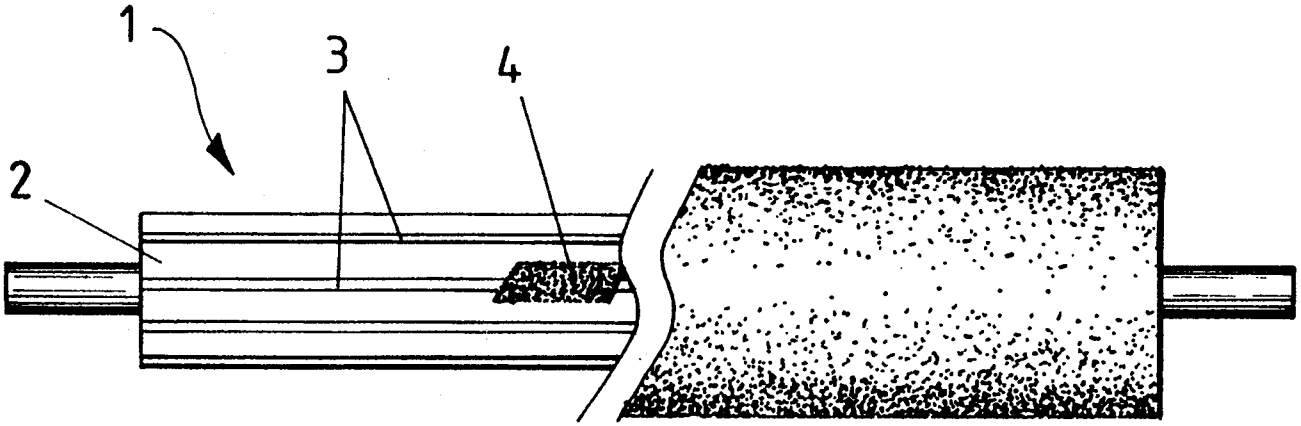
FIG. 1 illustrates a partially sectioned view of a brush roller constructed in accordance with the present invention.

In FIG. 1, one side of the brush roller 1 is shown without the brush elements 4. Only one brush element 4 is drawn on the left-hand side of the brush roller 1. The brush roller 1 includes guides 3, or slide rails, attached to the surface of its cylinder 2. In terms of the profile surface, these can be in other way arbitrary, but they must be able to grip an indentation in the brush element 4.

The ends of the elements are slanted in the direction of the rail, in which case the transfer point is made movable.

Figure 2:
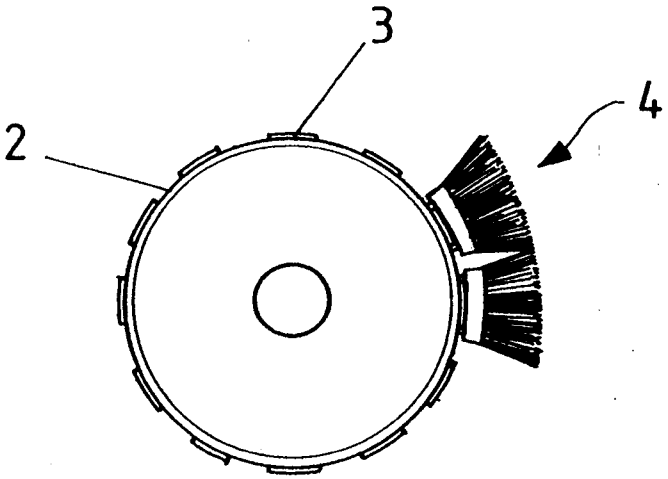
FIG. 2 illustrates a cross-sectional view of the brush roller of FIG. 1.

In FIG. 2, two brush elements 4 are attached to the guides 3, whereas the other guides 3 are without brush elements. A sufficient number of guides is attached to the cylinder 2, so that the entire circumference is covered with brush elements.

In FIGS. 3 through 6F, the structure of the brush element 4 is shown. The brush element 4 is constructed on a hard plastic frame 5. The base of the frame is drilled densely with holes 13, through which the bunches of bristles 6 are pushed as best seen in FIG. *6c*. The bunches are brought through in such a way that a U-shaped staple 10 is formed in the bend 9 in the bunches FIG. *6b*, the head of which very slightly protrudes from hole 13. The staples 10 protrude almost in their entirety after a cast component or hardenable adhesive 8, which here is most advantageously formed by polyurethane-base resin, is poured into the trough formed by the frame 5, FIG. *6d*. The viscosity of this should be suitable, so that it is absorbed by the brush fibers up to the thickness of the base section. The cast component or hardenable adhesive is poured nearly to the level of the outer surface of the edge section of the brush frame and before the resin hardens, an aluminum securing section 14 is sunk into it, FIGS. *6e* and *6f*. Securing section 14 includes an indentation 7 and protruding grips 12. Grips 12 become firmly attached or bonded to the cast component or hardenable adhesive 8 as it hardens.

In practical experiments, it has been noted that a suitable sealing strip 11 is necessary between the aluminum counterparts, the indentation 7 and the rail 3. This both takes up the gap and prevents mechanical damage when the elements are being pushed into place. In this respect, teflon tape has been found to be the most advantageous sealant.

An automatic machine can be used to place the tufts formed of the above mentioned bristles 6 into the perforated frame section. The method of manufacture deviates, however, from the known method of attaching bristles in that here the hole is drilled through the piece, whereas in a normal brush frame the hole does not extend through the frame section, so that a staple that bends and collects the tuft can be fired into the brush frame.

Nearly three times the amount of brush bristles can be attached to the same surface area of a brush element in accordance with the invention when compared to a brush made by hand-binding. The glazing characteristics and useful life of the glazing brush have been shown to improve in direct relation to the number of bristles used.

The number of brush bristles 6 in FIG. 4 can still be doubled in comparison with the previous form of construction. In this, the frame section 5 includes raised edges on the side of the bristles 6. These form vessels, into which a suitable cast component, hardenable adhesive or other binder 8 can be poured, into which the bristles, which are presecured or compressed by a clip, are immersed.

Here, the frame section 5 includes an indentation 7 that is formed in itself, and which forms a suitable groove for the guide 3 of the brush roller 1. Correspondingly, a rail can also be machined in the cylinder itself.

FIGS. *7a–7d* illustrate the construction of an alternative embodiment of the invention wherein like reference numerals refer to hereinabove similar structure. The brush element 4' is fabricated and includes a frame 5' and also a base portion 15, preferably consisting of a plastic lath, having inner and outer sides 16, 18 and also an attachment section or securing section 14' including first and second sides 20, 22. The inner side 16 of the frame 5' is spaced from and opposes the second side 22 of the attachment section 14'. Preferably, the attachment section 14' consists of an aluminum profile. The attachment section 14' has edge lugs 24 and grips 12'. The section 14' is fixed to the base section 15' by the edge lug 24.

With continued reference to FIG. *7c*, apertures 13' are formed in the base portion 15 by drilling or any other suitable method. The apertures 13' are drilled to provide a tight fit around bristles 6'. As illustrated in FIGS. *7a* and *7b*, a plurality of bristles 6' are folded in half over a U-shaped staple 10', having a bent portion 10*a*, leg portions 10*b* and ends 10*c*, such that the free ends of the bristles extend in a direction away from the leg portions of the U-shaped staple.

As illustrated in FIG. *7d*, the U-shaped staples 10' are inserted into the formed apertures 13' in the base portion 15 such that the folded portion 9' of the bristles 6' is on the inner side 16 of the base and the free end portion extends from the outer side 18 of the base portion. The legs 10*b* and ends 10*c* of the staple 10' are bent and in a collision with the second side 22 of the attachment section 14'.

The tight fit of the bristles 6' in apertures 13' hold the bristles in place and the bristles 6' carry the staples 10, FIG. *7d*, until pouring the cast component 8' and during the hardening of the hardenable adhesive. As hereinabove described, the cast component or hardenable adhesive 8' is poured along the inner side 16 of the base portion 15 around the bent or folded portion 9' of the bristles 6' and staples 10', to embed the staples in the adhesive as it hardens and to affix the bristles to the base portion and embed the folded portion 9' in the cast component'. The result is that the staples 10' are completely recessed in the cast component 8' as seen in FIG. *7e*. The staples 10' also reinforce the hardenable adhesive or cast component 8'.

In addition to bonding the staples 10' in the adhesive 8' as it hardens, the cast component or hardenable adhesive fills the space between the inner side 16 of the base portion 15 and the second side 22 of the attachment section 14. As the cast component or hardenable adhesive 8' hardens or sets up or cures, the grips 12' also become bonded in the adhesive and the attachment section is further connected to the base portion.

In the embodiment of the brush element 4' illustrated in FIGS. *7d* and *7e*, the staples 10' that are inserted into the apertures 13' have their leg portions 10*b* bent prior to the pouring of the hardenable adhesive or cast component 8' to impede any removal of the staples 10' from the hardened cast component and thereby from the brush element. The leg portions 10*b* of the staples 10' can be bent any number of ways as is readily understandable to make it more difficult to remove the staples from the cast component or hardenable adhesive.

FIG. 8 illustrates another embodiment of the brush element 4'' including integral base and attachment portions 15'', 14'' formed of a one-piece plastic construction including a hollow portion 20 formed between the portions. Brush element 4'' is otherwise similar in construction as the embodiment of FIG. 7 and like reference numbers are used to refer to similar features.

While the best mode for carrying out the invention has been described in detail, those familiar with the art to which this invention relates will recognize various alternative designs and embodiments for practicing the invention as defined by the following claims.

What is claimed is:

1. A method of making a brush element for a brush roller, the brush roller including a mounting means for mounting the brush element, the method comprising the steps of:

fabricating a frame including a base portion having outer and inner sides and also an attachment section including first and second sides; the inner side facing and spaced from the second side;

forming apertures in the base portion;

forming bunches of bristles, each bunch being formed by folding a plurality of bristles in half over a U-shaped staple having a bent portion, leg portions and ends, such that the bristles have folded portions with free ends extending in a direction away from the leg portions of the U-shaped staple;

inserting the staples of the bunches, one into each of the formed apertures in the base portion such that the folded portions of the bristles are on the inner side of the base portion and the free ends extend from the outer side of the base portion;

pouring a hardenable adhesive along the inner side of the base portion around the folded portions of the bristles and staples to bond the staples in the adhesive as it hardens and to affix the bristles to the base portion; and bending the leg portions of the inserted staples prior to pouring the hardenable adhesive, thereby impeding any removal of said staples from said apertures and hardened adhesive;

wherein the step of bending comprises colliding the leg portions with the second side of the attachment section.

2. The method of claim 1 wherein said hardenable adhesive is a polyurethane-base resin.

3. The method of claim 2 wherein said polyurethane-base resin is of a viscosity to be absorbed between the bristles adjacent their folded portions.

4. The method of claim 1 wherein the step of forming said apertures comprises forming holes that provide a tight fit for the bristles in said base portion thereby causing the bristles to remain in place during the pouring and hardening of the hardenable adhesive.

* * * * *